US005431201A

United States Patent [19]

Torchia et al.

[11] Patent Number: 5,431,201

[45] Date of Patent: Jul. 11, 1995

[54] ROBOTIC ADMIXTURE SYSTEM

[75] Inventors: Mark G. Torchia; Dennis D. Cote; Ken J. McTaggart; Craig P. Judt, all of Winnipeg, Canada

[73] Assignee: Technology 2000 Incororated, Winnipeg, Canada

[21] Appl. No.: 161,278

[22] Filed: Dec. 3, 1993

[51] Int. Cl.[6] ..... A61J 1/00; B01F 13/00

[52] U.S. Cl. ..... 141/98; 141/83; 141/114; 141/100; 141/329; 141/18; 366/211; 901/6; 422/67

[58] Field of Search ..... 141/1, 2, 98, 130, 329, 141/330, 9–11, 18, 21, 25, 83, 100, 103, 104, 114; 422/63, 67; 901/6, 8; 366/209–211

[56] References Cited

U.S. PATENT DOCUMENTS

| | | | |
|---|---|---|---|
| 4,648,430 | 3/1987 | Di Gianfilippo et al. | 141/1 |
| 4,842,028 | 6/1989 | Kaufman et al. | 141/114 |
| 5,122,342 | 6/1992 | McCulloch et al. | 422/67 X |
| 5,203,385 | 4/1993 | Waber | 141/83 X |
| 5,309,959 | 5/1994 | Shaw et al. | 141/130 |
| 5,341,854 | 8/1994 | Zezulka et al. | 141/1 |

FOREIGN PATENT DOCUMENTS

| | | | |
|---|---|---|---|
| 1317262 | 5/1993 | Canada | 141/98 |

OTHER PUBLICATIONS

Report—American Journal of Hospital Pharmacy vol. 46 Nov. 1989 (8 pages).

*Primary Examiner*—J. Casimer Jacyna

*Attorney, Agent, or Firm*—Adrian D. Battison; Stanley G. Ade; Murray E. Thrift

[57] ABSTRACT

A system for filling containers with a prescribed medication includes a support head for receiving a disposable syringe which allows the syringe to be pumped to transfer liquid to an from the syringe. A robot arm is also provided to carry medication and diluent containers to the syringe for withdrawing diluent to the syringe and injecting it into the medication container for mixing. In order to ensure alignment of the containers with the syringe, there is provided on the support head an additional needle grasping system which grasps and locates the needle for penetration of the membrane of the container. The support head includes a weigh scale as an integral element thereof so that the syringe is weighed after each step of the process. The syringe is actuated in a pumping action to inject air into the container and to withdraw liquid from the container and to maintain at the termination of the pumping action a partial vacuum within the container so that any liquid tending to escape as a drop is drawn back into the container and is prevented from escaping to atmosphere. The medication containers and the diluent container together with a syringe are supplied on a rack body so that each prescription to be filled can be set up in advance on a separate rack body and that rack body inserted into the apparatus in turn and located on a base member of the apparatus. A separate mixer is provided for receiving the medication container from the robot arm for effecting an oscillating mixing action while the robot arm effects functions on a further container.

18 Claims, 9 Drawing Sheets

ROBOTIC ADMIXTURE SYSTEM

BACKGROUND OF THE INVENTION

This invention relates to a robotic admixture system for admixing medications into a dispensing container for dispensing to a patient.

Many medications are dispensed to a patient from an IV bag into which a quantity of the medication is introduced generally in admixture with a diluent. In some cases the IV bag contains only the medication and diluent. In other cases the IV bag also contains a carrier or other material to be infused into the patient simultaneously with the medication. Medication can also be dispensed from a syringe.

Medication is generally supplied in powder form in a medication container or vial. A diluent liquid is also supplied for admixture with the medication in a separate or diluent container or vial. As is well known to the pharmacist, different medications require different diluents and different prescriptions require different amounts of diluent and different amounts of the admixture for submission to the patient.

One repetitious function of the pharmacist is therefore to prepare dispensing containers, generally IV bags, containing the prescription for the different patients to be supplied from the pharmacy. Many IV bags of this type require a single medication which is repeated in a number of the IV bags for example insulin which is of course dispensed to many different patients. In such cases it is not necessary to tailor the prescription to the individual patient so that a number of similar IV bags containing the same medication can be prepared in a batch.

Other drugs and particularly chemotherapy drugs require very accurate and careful control of the prescription so that it is necessary to carefully tailor the prescription to the individual patient.

In order to prepare a dispensing container of the medication, the pharmacist takes a vial of the medication as prescribed and one or more vials of the diluent to be admixed therewith. The pharmacist then draws from the diluent container a predetermined quantity of the diluent into a sterile disposable syringe by passing the needle into the vial through the elastic membrane closing the vial. In order to extract the liquid from the vial it is necessary to replace the extracted liquid with air and therefore the syringe is actuated repeatedly to pump air into the vial and to extract liquid from the vial until the required quantity is extracted as measured by the markings on the syringe. A syringe is chosen of a suitable size so that the amount to be extracted constitutes a significant proportion of the total volume of the syringe in order to provide an accurate measurement. The pharmacist therefore must before starting select the medication vial of the required size, the diluent vial or vials of the required size and also a syringe of the required size.

After the filling the syringe to the required amount of diluent, the pharmacist then injects the diluent into the medication container again penetrating the elastic membrane with the needle and again repeatedly injecting liquid and withdrawing air until the total quantity of the required diluent is introduced into the medication container.

The pharmacist then effects a shaking action on the medication container until the medication and diluents are properly mixed. In some cases this is relatively straight forward. In other cases extensive shaking of the container is required. In yet further cases extensive shaking is required together with extended periods of standing to obtain the complete admixture necessary. Mechanical shaker devices are available of various different designs to assist in the shaking action which can otherwise become physically demanding.

When the medication is fully mixed with the diluent, it is again necessary to withdraw from the medication container a required quantity of the admixed medication and a diluent for insertion into the dispensing container. This is again effected by the disposable sterile syringe which is utilized to repeatedly inject air and remove liquid until the required quantity of the liquid is withdrawn into the syringe. This required quantity is then dispensed into the dispensing container and generally the use of an IV bag allows the liquid to simply be injected into the IV bag without concern for pressures since the IV bag is flexible. In some cases the syringe itself is used as the dispensing container so that there is no need for the final step of supplying the medication into the dispensing container.

It will be appreciated, therefore, that this process is relatively lengthy and physically demanding, leaving significant potential for error in view of this combination.

It has been previously been proposed that a robotic ad-mixture system be developed which enables the dispensing containers to be filled with the required quantity of the required admixture of diluent and medication. One published proposal is set forth in the American Journal of Hospital Pharmacy Vol 46 November 1989 which discloses preliminary work carried out by some of the inventors in the present application.

This preliminary work disclosed the use of a robot arm and a syringe manipulation head which receives a syringe of a predetermined size and activates the plunger of the syringe to withdraw and expel liquids into the required containers. The head is rotatable about a horizontal axis so that the syringe can be inverted for withdrawing liquids and can face downwardly for dispensing the liquid.

However this work was only of a preliminary nature and did not provide a fully functioning system including all of the required steps to lead to a commercially viable robotics system.

The only other work in this area which is known to have occurred is that carried out in Red Deer, Alberta, Canada and shown in Canadian patent 1,317,262 issued on May 4th, 1993 to the inventors Zesulka et al which proposes a system for a pharmacy which handles the medication and diluent containers and manipulates these to the required positions for admixture. It is believed that the system includes a complex double ended needle arrangement which allows injection of the diluent into the medication container. However this system has not led to a commercial construction and is currently believed only to be in the proposal stage.

SUMMARY OF THE INVENTION

It is one object of the present invention, therefore, to provide a robotic admixture system for admixing medication and for filling a dispensing container with the admixture in a required prescription.

According to a first aspect of the invention there is provided an apparatus including a robot arm for manipulating the containers and a support head for supporting a syringe for extracting and dispensing the liquids. On the support head there is provided a needle grasping means separate from the medication container which grasps the needle on the support head to hold it in fixed position directly on an axis of the syringe cylinder so that the needle is held in place for engagement through the membrane of the container.

According to a second aspect of the invention the support head which carries the syringe includes a weigh scale directly supporting the syringe so that the amount of liquid drawn into or dispensed from the syringe can be measured by effecting a measuring action before and after each action of the syringe. The support head can also include a device for supporting the IV bag when filled to again measure the weight within the IV bag for further checking of the dispensed amount.

According to a further aspect of the invention there is provided an arrangement in which the syringe is operated to reduce or inhibit the escape into the atmosphere of liquid from the needle or from the medication container. This is effected by pumping the syringe to inject air into the container and to extract liquid from the container in a number of pumping actions. The volume of air relative to the amount of liquid is maintained so that the medication container is held in a partial vacuum. When the syringe is withdrawn, the plunger is held fixed so that the partial vacuum is maintained thus acting to draw back into the medication container the liquid which lies between the needle and the container.

According to a yet further aspect of the invention the apparatus is provided with a support rack for each prescription to be filled. The apparatus further includes a base member with an element on the base member which locates each supply rack which is moved into position on the base member for filling of the prescription and then is withdrawn from the base member after the prescription is filled.

According to a yet further aspect of the invention the apparatus includes a separate mixing device so that the medication containers when filled with the diluent and the medication can be released from the robot arm and placed onto the mixing device. In this way mixing can continue in a shaking action while the robot arm continues to effect other functions.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
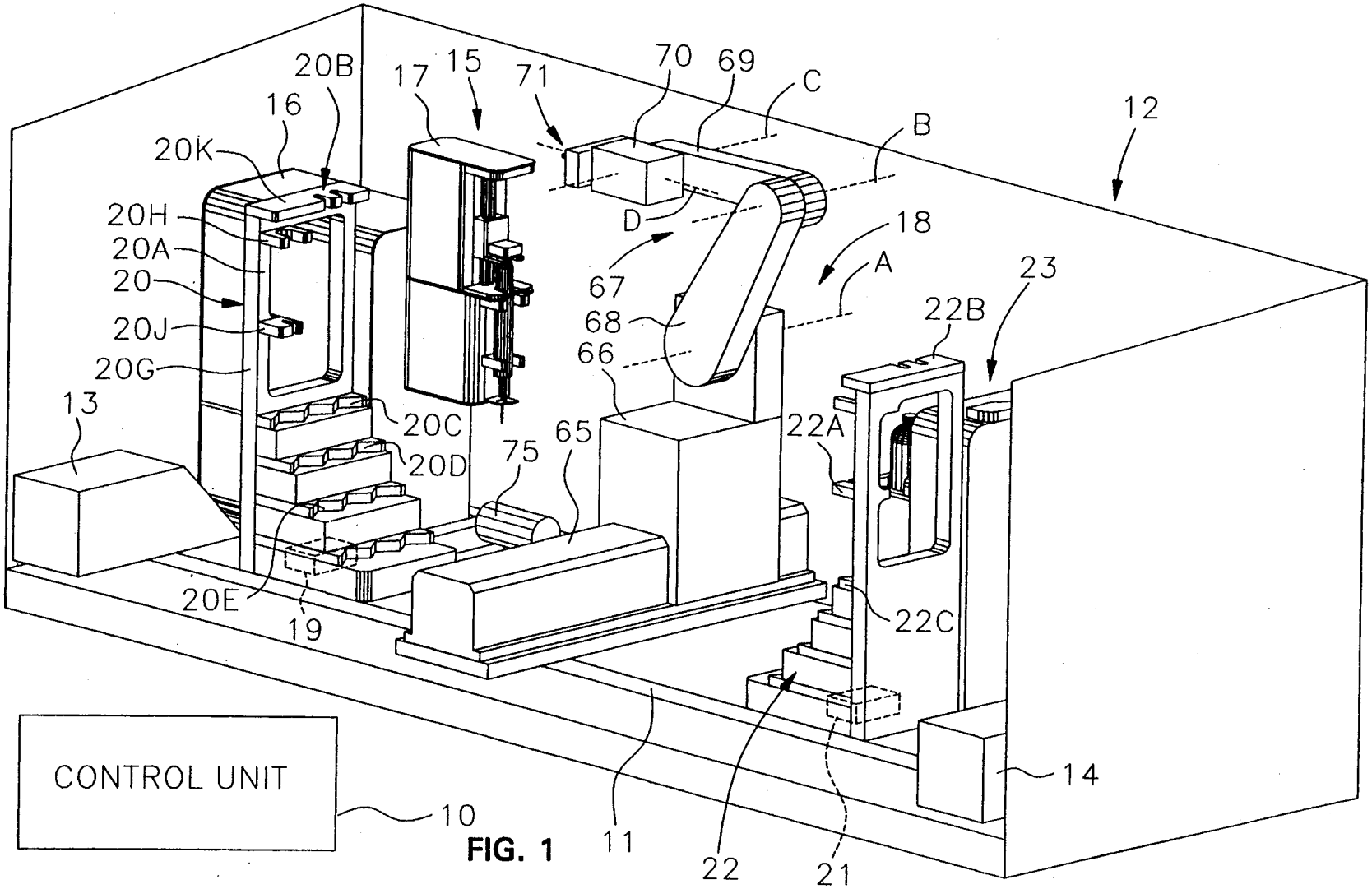
FIG. 1 is an isometric view of the robotic admixture system.

The robotic admixture system as shown in the drawings comprises a control unit 10 which comprises a computer system and associated software for controlling the functions as described hereinafter. The details of the software are not described as one skilled in the art can generate the necessary software control systems to actuate the functions as set forth. The control unit interfaces with the mechanical systems as described hereinafter and again the details of the interface system are not shown as these will be apparent to one skilled in the art.

The apparatus further includes a base 11 which is dimensioned and arranged to be received within a conventional biological containment cabinet 12 shown only schematically. Most pharmacies include a biological containment cabinet of the general type having dimensions of the order of 6 feet wide by 3 feet deep by 6 feet feet high, which includes the necessary covers, extraction duct and filtration system to allow noxious pharmaceuticals, particular anti-neoplastic agents, to be handled in a manner which avoids or reduces contamination to the pharmacist or technician.

Thus the base comprises an elongate plate having a length of the order of 6 feet and a width of the order of 1.5 feet to be received within the cabinet 12. The cabinet generally includes a front opening which allows the operator to access the interior. Upon the base is mounted a pair of housings 13 and 14 which contain an infra red security beam system again of a conventional nature with a beam being transmitted across the front face of the cabinet 12 that is along a front edge of the base so that when the device is in operation, any interference of the beam by an intruder will be detected and the system halted.

The base supports the following elements:

a) A syringe manipulation system generally indicated at 15 which includes a support housing 16 and a syringe manipulation head 17 mounted on the housing for rotation about a horizontal axis longitudinal of the base 11.

b) A robot arm system 18. In one example this can be of the type supplied by Hewlett Packard and known as ORCA.

c) A rack is engagement system 19 for receiving a supply rack 20 of the containers.

d) A second rack engagement system 21 for receiving a discharge rack 22 of the containers at the completion of the filling of the dispensing container.

e) An oscillating mixer system 23 for receiving the containers when filled with the medication and diluent for oscillating those containers in a mixing action.

Figure 2:
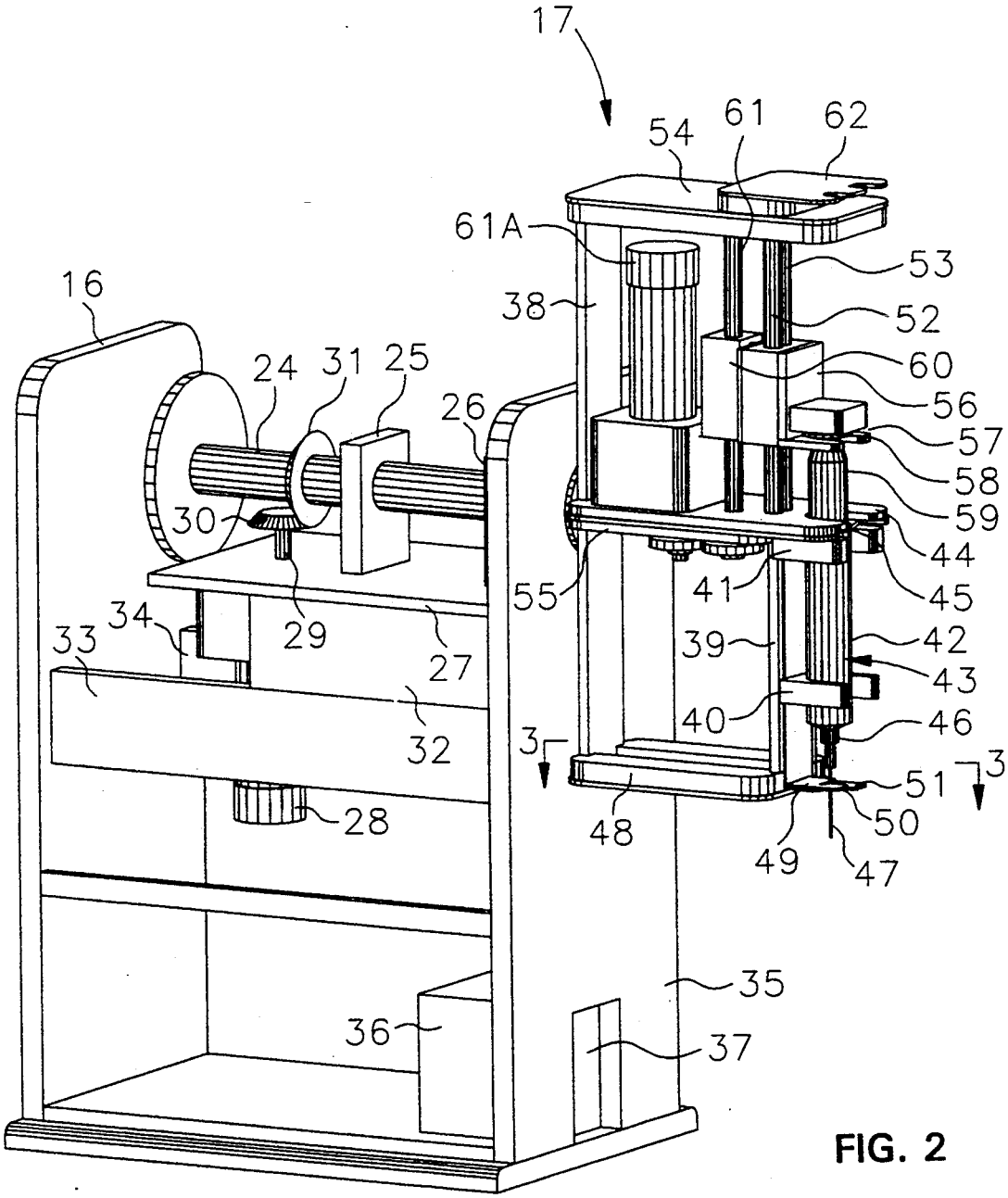
FIG. 2 is an isometric view of the syringe manipulation system of FIG. 2 with the covers of the support head removed to show the elements therein.
Figure 3:
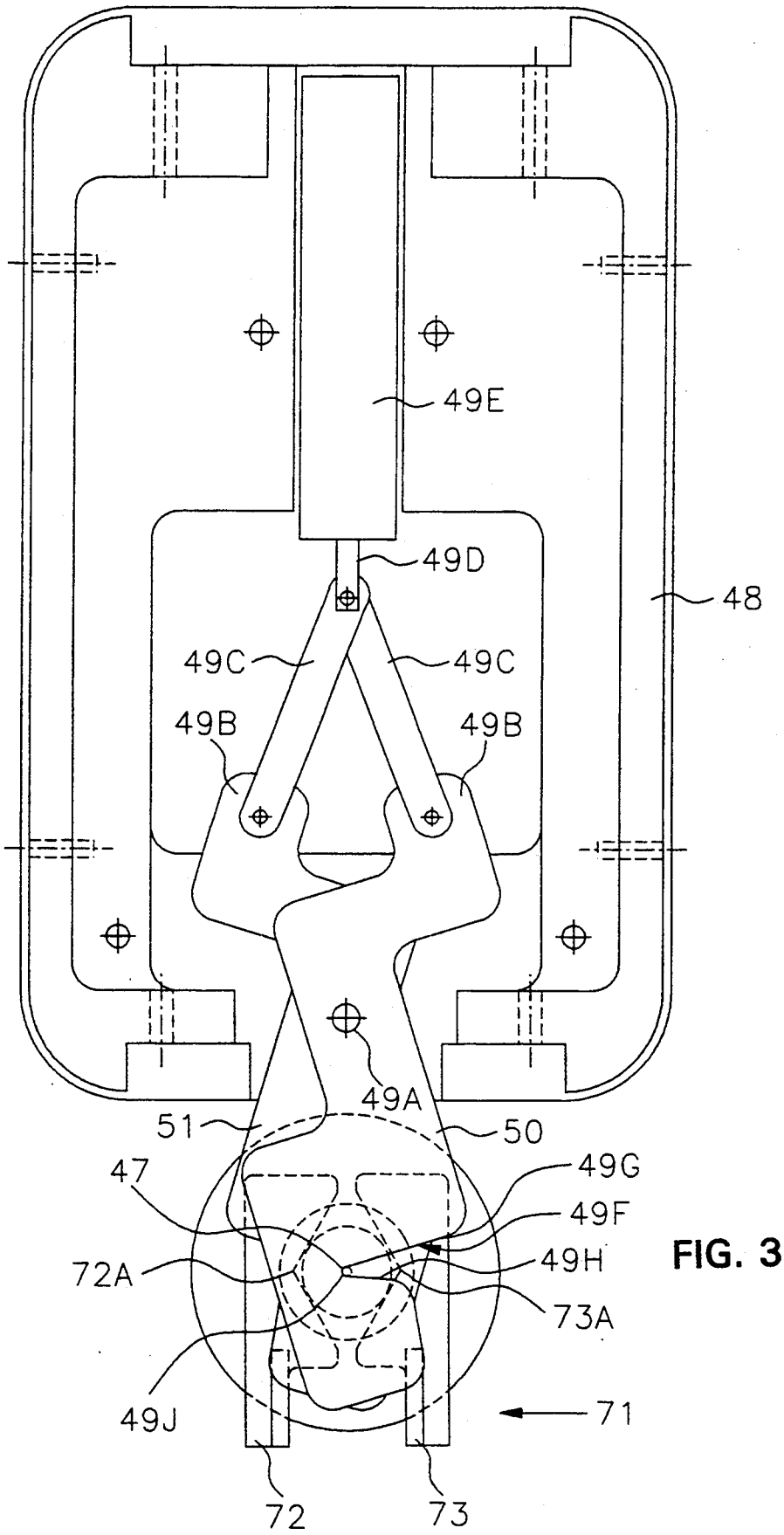
FIG. 3 is a cross sectional view along the lines 3—3 of FIG. 2 showing the needle aligned with a vial.
Figure 4:
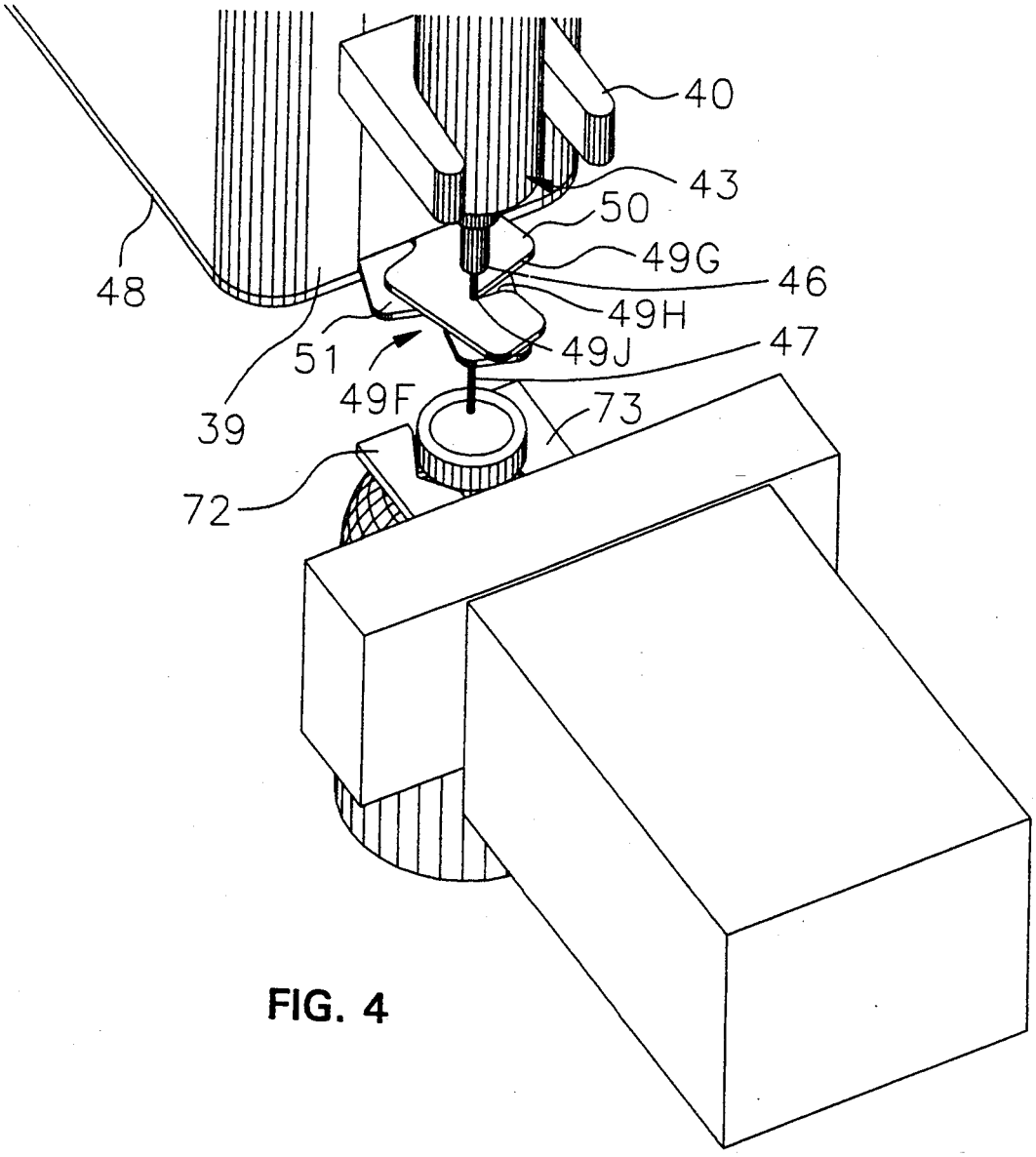
FIG. 4 is an isometric view showing the lower part of the syringe manipulation head and the grippers of the robot head holding a vial in position at the needle.

The syringe manipulation system is shown in more detail in FIGS. 2, 3 and 4. The housing 16 contains a main shaft 24 carrying the head 17. The main shaft 24 is carried on bearings 25 and 26 supported on a main horizontal support plate 27 sitting within the housing and free from the outside covers of the housing. The plate also carries a motor drive assembly 28 driving a shaft 29 which in turn drives bevel gears 30 and 31 for rotating the shaft 24 about an axis longitudinal of the shaft that is the horizontal axis of rotation of the head 17 so as to move the head between a first position in which the needle is presented downwardly as shown to a second position in which the syringe is inverted and the needle presented upwardly.

The horizontal plate 27 is mounted on an integrated analytical balance 32 carried on a pair of plates 33 and 34 inside the housing. The balance provides a readout of the instantaneous mass of the element supported thereon that is the shaft, drive system for the shaft and the head 17 including the syringe when carried on the head. The balance can therefore provide at predetermined times as interrogated by the control unit the mass of the system. In this way the weight of liquid transferred to or from the syringe can be detected by subsequent interrogations by the control unit. In this way the control unit can track the amounts of liquid drawn into the syringe and expelled from the syringe at selected times during the operation of the device.

At the base of the housing on a front face 35 of the housing is provided a bar code reader 36 for reading the bar code of elements presented to a window 37 of the bar code reader in the front face 35.

The syringe support head 17 comprises a housing having a rear wall 38 attached to an outer end of the shaft 24 so that the housing is rotatable with the shaft about the axis of the shaft as previously described. The housing further includes a front wall 39 on which is mounted a pair of U shaped receptacles 40 and 41 for receiving the body 42 of a syringe generally indicated at 43. The support head is designed to receive only a single predetermined size of syringe and preferably this is of the order of 30 ml syringe so that the U shaped receptacles 40 and 41 are of fixed dimension so as to engage the outer surface of the syringe body 42 in a friction fit and so as to define a semi cylindrical surface of the receptacle which wraps around a rear part of the syringe when brought into position within the receptacles.

Above the receptacle 41 is provided a further receptacle 44 which is shaped to receive and confine a flange 45 at the end of the body 42 of the syringe. The flange thus slides into a slot underneath the receptacle 44 and above the receptacle 41 so as to hold the flange in fixed position against movement in a direction longitudinally of the syringe 43.

The receptacles 40, 41 and 44 thus accurately locate the syringe body in a position lying along an axis at right angles to the axis of the shaft 24. The syringe further includes a needle lock system 46 carrying a needle 47 conventionally provided with the syringe. The needle 47 thus projects outwardly from the end of the syringe body below the receptacle so that the syringe projects beyond a bottom plate 48 of the housing of the support head 17. On top of the end plate 48 is mounted a needle grasping system 49 including a pair of jaws 50 and 51.

The shape and arrangement of the jaws 50 and 51 is shown in more detail in FIG. 3. The jaws are similarly shaped and one is inverted relative to the other. Each includes an opening for a pivot pin 49A about which the jaws can pivot in a horizontal plane with one jaw arranged in sliding contact with the top surface of the other jaw. Rearwardly from the pivot pin 49A each jaw includes an offset leg portion 49B connected to an actuating link 49C operated by an armature 49D of a solenoid 49E. Thus forward and rearward movement of the armature effects opening and closing of the jaws about the pin 49A. Each jaw includes a slot 49F defined by V shaped guide surfaces 49G and 49H which converge to a base 49J of the slot 49F. In the closed positions of the jaws, the base of one jaw lies directly over the base of the opposed jaw so that the needle 47 is confined to lie directly at the base of both jaws. Thus if the needle is slightly misaligned from the axis of the syringe, the needle is grasped by one or both of the jaws and slides along the surfaces until it is guided to the intersection between the bases 49J that is a position directly lying on the axis of the syringe.

The head 17 further includes a pair of shafts 52 and 53 in fixed position in a top plate 54 and in a middle plate 55 so that the shafts are directly parallel to the axis of the syringe. A slide housing 56 is mounted on the shaft for sliding movement longitudinally of the shafts. The housing 56 is shaped to define a slot 57 for receiving the flange 58 at the outer end of the plunger section 59 of the conventional syringe 43. The housing 56 is driven longitudinally of the shafts 52 and 53 by a nut 60 in engagement with a lead screw 61 mounted in the housing and rotatable about a longitudinal axis parallel to the shafts 52 and 53 by a motor drive system 61A.

In operation of the syringe manipulation system 15, therefore, the syringe is grasped by the robot arm as described hereinafter at a position along the length of the body 42 of the syringe and is carried by the robot arm and oriented with the needle thereof pointing downwardly and the axis thereof directly vertical. At this time the control unit is operated to move the housing 56 and the slot 57 to the lowermost position thereof immediately adjacent the slot 44. At the same time the linkage of the needle grasping system 49 is operated to open the jaws 50 and 51. The robot arm then moves the syringe from a position spaced outwardly from the receptacles 40 and 41 in a direction transverse to the longitudinal axis of the syringe so as to slide the flange 45 and the flange 58 into the slots 44 and 57 respectively and so as to engage the body 42 of the syringe into the receptacles 40 and 41. This positions the needle approximately between the jaws 50 and 51 of the needle grasping system. At this time the robot arm releases the syringe body and the control unit actuates the linkage of the needle grasping system 49 so as to close the jaws and move the needle to the required position lying directly along the axis of the syringe. This therefore holds the needle directly vertical and aligned with the longitudinal axis of the syringe.

The control unit can thereafter operate the drive motor system 61A to rotate the lead screw 61 and drive the housing 56 and plunger of the syringe to actuate filling and expelling of the syringe as required. The components are manufactured to a high degree of accuracy so that using a 30 ml syringe the system can be operated to deliver volumes in the range 0.5 to 100 ml. The smallest volume in this range is effected by very careful very small movement of the lead screw 61. The maximum dispensing volume is effected by repeated use of the syringe filling the syringe to effectively the maximum volume. The 100 ml maximum volume is of course not a maximum that the system will achieve but is instead the maximum which is intended to be generally used in practice.

The head further includes a support bracket 62 mounted on the end plate 54 for receiving and supporting a conventional double opening IV bag of the type manufactured by McGaw Inc of Irvine, Calif. The bracket can of course be modified to accommodate bags manufactured by other manufacturers or of different designs. The bracket 62 is thus mounted on the end plate remote from the needle and is intended that the bracket operate when the head is inverted so that the bracket 62 is at the bottom so that the IV bag can be suspended from the bracket downwardly from the plate 54 toward the base. The bracket 62 includes a horizontal plate which has two recess in its front edge each for receiving a neck of the openings in the conventional bag so that the bag is suspended by the two necks from the bracket.

In this way the weight of the whole system incorporating the syringe can be detected at various times during the process as described hereinafter for communication of the weight of liquid drawn into the syringe or expelled from the syringe as required. In addition the weight of the bag before and after filling can be detected simply by transporting the bag by the robot arm and suspending the bag from the bracket 62. This repeated weighing of the IV bag or dispensing container and the syringe at various times during the process enables the control unit to generate an audit trail of the liquids drawn from the diluent container into the syringe, expelled from the syringe to the medication container, drawn into the syringe from the medication container and expelled to the IV bag to ensure accuracy and also to ensure that a check on the accuracy can be completed after the operation is complete.

The integrated analytical balance can be of a type providing accuracy to a 100 micrograms.

The robot arm 18 is preferably of the type manufactured by Hewlett Packard and comprises a base frame 65 mounted on the base 11 at a fixed position on the base. The base frame 65 includes a drive system moving a vertical support 66 horizontally in a direction transverse to the base 11 so as to obtain movement transversely of the base 11. On the vertical support is mounted an arm 67 including a first arm portion 68 and a second arm portion 69. The arm portion 68 is mounted on the vertical support 66 for rotational movement about a horizontal axis A parallel to the direction of movement to the vertical support 66. The second arm portion 69 is mounted on the end of the first arm portion 68 for rotational movement about a second horizontal axis B parallel to the first horizontal axis. The robot arm further includes a clamping block 70 mounted on the outer end of the second arm portion 69 for rotational movement about a third horizontal axis C parallel to the axes A and B. In this way, as is well known, the position of the clamping block 70 can be moved to any position within the envelope of the robot arm and the orientation of the clamping block can be altered about the axis C to maintain that orientation in the horizontal position as shown or to turn to an alternative orientation if required. Generally in the present system the operation is effected with the clamping block in the horizontal orientation.

At the forward face of the clamping block is provided a clamping finger system 71 including a pair of clamping fingers 72 and 73 (FIGS. 3 and 4). The clamping fingers can be moved inwardly and outwardly to effect clamping and release of elements between the clamping fingers as required. The clamping fingers can also be rotated about an axis D at right angles to the axis C but in general this is not required in the present system since the fingers are maintained in most operations in a horizontal plane. The shape of the clamping fingers is shown in FIG. 4 and it will be noted that each of the clamping fingers has a V shaped surface on the inside facing edges with the V shape surfaces diverging outwardly to an apex 72A,72B located at the central position on the fingers. This shape acts to centre any body grasped by the finger so they tend to slide longitudinally of the fingers to take up a position in which the widest point of the body is received aligned with the apex of the fingers. This aligning action thus moves a vial when grasped forwardly or rearwardly of the fingers to take up the required position in which the axis of the vial lies in the vertical plane containing the apexes of the fingers. Similarly the grasping of the syringe will effect centering of the syringe to the same location.

As explained previously, the base includes two locating elements 19 and 21 in the form of guide blocks fixed to the upper surface of the base which receive respectively guide recesses in the supply rack and discharge rack for a dispensing process. As illustrated in FIG. 1, the supply rack shown is of a type for dispensing a single prescription and hence has a location 20A thereon for receiving a single disposable syringe, a location 20B for receiving a single IV bag to be filled, and a plurality of locations 20C, 20D and 20E for medication containers and diluent containers for completing that prescription.

Similarly the discharge container includes a single location 22B for receiving the filled IV bag, a location 22A for the used syringe and locations 22C for the emptied or used medication and diluent containers.

The rack 20 thus includes four rows of locations for the medication and diluent containers, each row having three separate locations thereon. Each location is generally V shaped so that a container can be pushed rearwardly against the V shaped surface to locate that container directly at the apex of the V shape thus centering a vertical axis of the container. The four rows are stepped so the lowest row is furthest forward and three further rows step backwardly toward a rear wall 20G of the rack. The location 20A for the syringe comprises an upper receptacle 20H for engaging the body of the syringe and a lower receptacle 20J for receiving the lower needle lock portion of the syringe thus locating the syringe at a predetermined height and with the axis of the syringe vertical and at a predetermined position transversely of the rack. The location 20B for the IV bag comprises a pair of recesses in the front face of a top flange 20K of the rack, the recesses being similar to the recesses of the bracket 62 simply to receive the two necks of the IV bag and to locate the neck for grasping by the clamping fingers 72 and 73 of the robot arm.

The rack 22 is substantially identical to the rack 20 and these can indeed be interchangeable.

Figure 5:
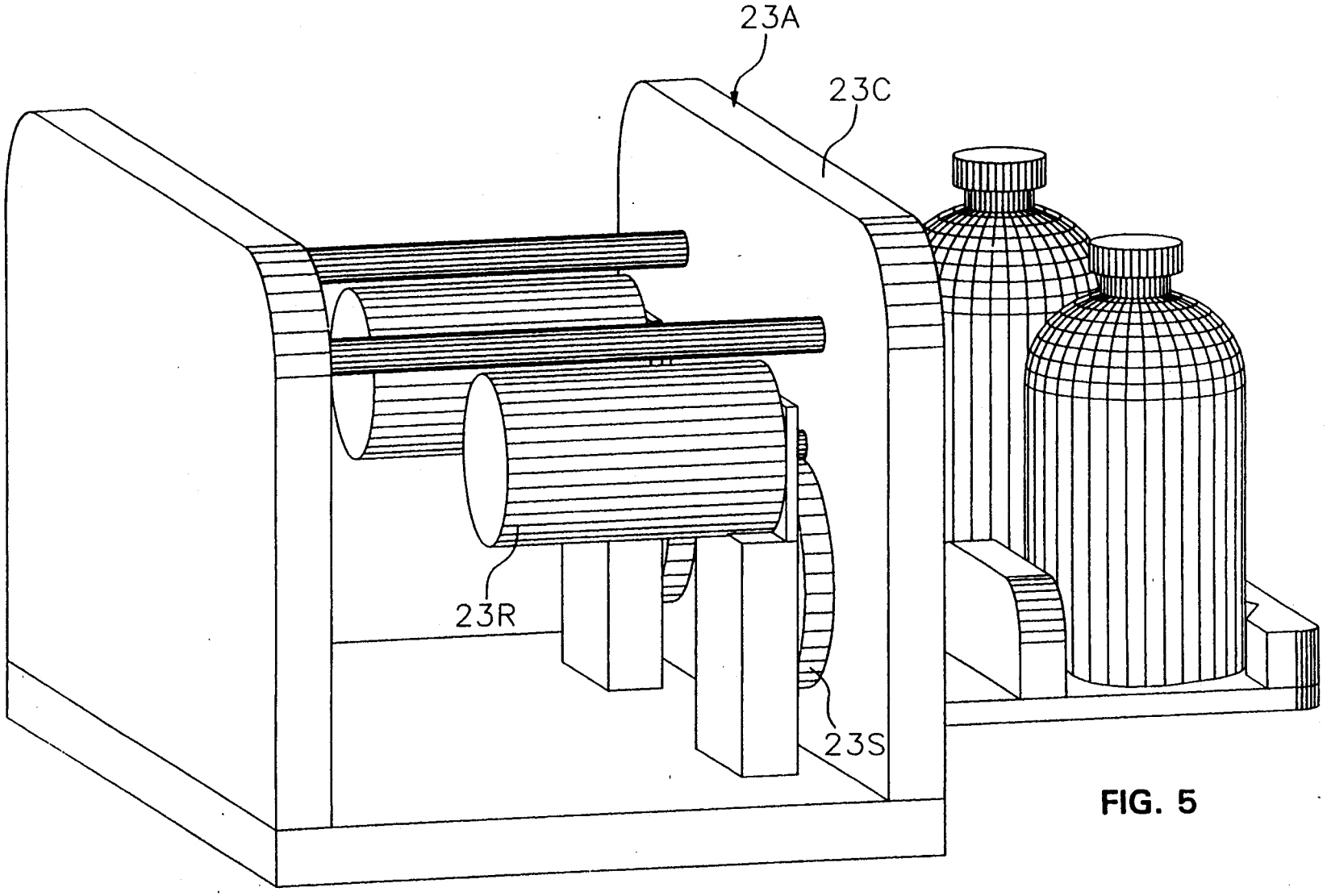
FIG. 5 is an isometric view of the mixing device of FIG. 1 showing the covers removed.
Figure 6:
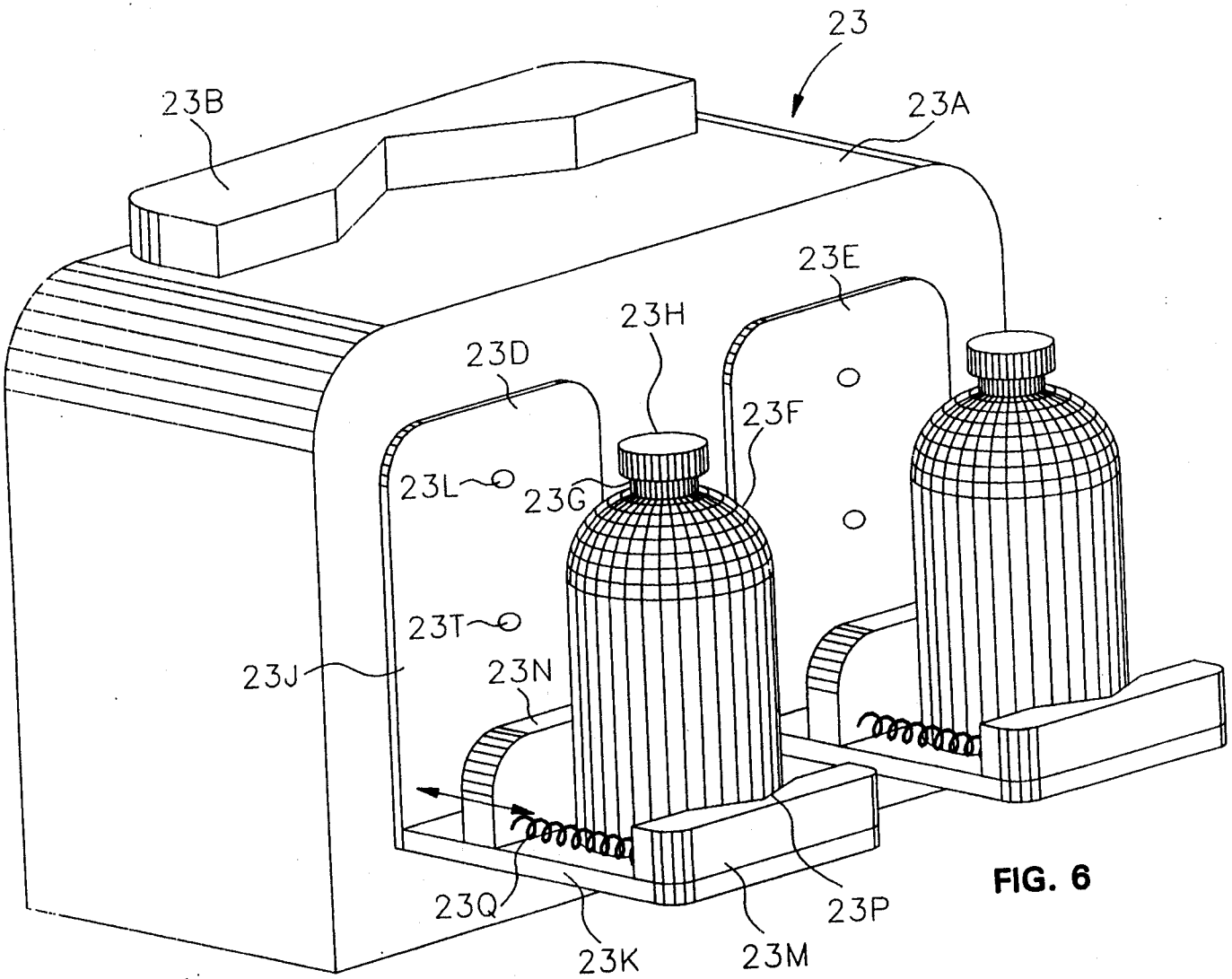
FIG. 6 is an isometric view of the missing device from the front and one side.

The mixer 23 is shown only schematically in FIG. 1 but is shown in more details in FIGS. 5 and 6. This comprises a housing 23A having a top wall on which is mounted a receptacle 23B for receiving a vial. The receptacle 23B comprises a V shaped surface which guides the vial to a predetermined position transversely of the top wall so that a vial can be placed on the mixer at that position simply in a storage location to allow the vial to stand while the robot arm carries out other functions or while the materials are being left to admix.

The housing includes a front wall 23C on which is mounted a pair of cradles 23D and 23E. Each cradle receives a single vial of the medication to be mixed. The vial comprises a main body 23F, a neck 23G and a top 23H in which is provided the elastic membrane. The vial is of course an entirely conventional construction. Each cradle comprises a back wall 23J and a horizontal base wall 23K on which the file is placed. The back wall is mounted on a pivot pin 23L which allows the cradle to pivot side to side in a pendulum action about the pivot pin 23L. The base 23K includes a fixed abutment 23M and a sliding abutment 23N. The fixed abutment 23M is at the front of the base 23K and is in fixed position upstanding upwardly therefrom. A rear wall of the fixed abutment is V shaped as indicated at 23P again to center the vial when positioned thereon. The sliding abutment 23N can move toward and away from the fixed abutment and is biased toward the fixed abutment by a pair of springs 23Q only one of which is visible on one side of the vial, the other of course being the other side. The height of the sliding abutment is greater than the fixed abutment so that the vial can be moved horizontally toward the cradle with the cradle in the central depending position and the bottom of the vial passes over the fixed abutment and engages the top of the sliding abutment to push the sliding abutment rearwardly until there is sufficient room between the abutment to receive the vials therebetween. The vial can then be moved vertically downwardly by the robot arm until it engages between the abutment on the base 23K. When the vial is then released, the sliding action of the sliding abutment tends to move it toward the fixed abutment and hold it clamped in position therebetween. The V shaped of the fixed abutment centralizes the axis of the container. This shape allows the robot arm to locate the container in position simply by horizontal and vertical movement and to remove the container simply by vertical movement.

With the container in place, the cradle is pivoted back and forth in a pendulum action by an individual drive motor 23R mounted on the rear of the front wall 23C. The motor drives a crank system 23S which oscillates the pendulum back and forth via a drive pin 23T.

The control unit shown schematically includes a computer input system having an operator work station and can also provide an easy interface to network existing information systems within the hospital environment or pharmacy environment as required.

The control system includes means for inputting into the memory information concerning the following:

a) The identification data of the patients.
b) The details of the patient for example the weight and height of the patient.
c) Information concerning the medications to be dispensed including the different types of medication, the bar code associated with that medication, the dimensions of the medication container, the different volumes of medication available for selection of a most efficient volume for a prescription.
d) Information concerning the diluent to be dispensed including the different types of diluent, the bar code associated with that diluent, the dimensions of the diluent container, the different volumes of diluent available for selection of a most efficient volume for a prescription.
e) The amount of mixing necessary for each medication
f) The specific drug prescription for the patient including drug type, dose, route of administration, dose schedule, physician name, patient location.
g) Identification of pharmacist or pharmacy technician.

The control unit uses the above information in associated with the operator work station to control all operations of the system in real time to carry out the following functions.

The operator inputs into the system the details of prescriptions required. This can be done in a batch for example at the beginning of a working shift or can be done individually as prescriptions are required during a working shift.

The control unit from the input prescriptions calculates, using the patient details, the amount of the medication and diluent required to fill a particular prescription. Thus in many cases the doctor will prescribe a predetermined amount of the medication per unit weight of the patient and the system will calculate therefore using the weight of the patient the amount of the medication required in volume terms. In other situations the prescription can be made in relation to an amount of medication per unit area of patient skin and again the system can calculate the volume of the medication and the unit area of patient skin required based upon the patient data previously input. (height and weight)

The control unit from the above information calculates the number and sizes of the medication and diluent containers required. Thus the control unit can select certain sizes of medication containers depending upon availability and can select the number of the medication containers to most efficiently meet the amount of medication and diluent required.

The operator work station provides to the operator a read out showing the required medication containers and diluent containers to be supplied by the operator. In practice the control station will provide to the operator information concerning a number of prescriptions in a row to be filled so the operator can prepare a number of trays containing the required prescription elements for a sequential processing of those prescription elements.

The operator after preparing the trays then deals with each prescription in turn at the machine. In order to process a particular prescription, the operator provides the dispensing container or IV bag to be filled, a sterile disposable syringe of the required dimensions, and the required medication and diluent container or containers. The syringe cap is removed by the operator.

The operator then selects a rack from a supply of the racks and places the syringe in position on the rack as previously described and places the IV bag in position on the rack as previously described. The operator work station then specifies to the operator the particular medication and diluent containers required and specifies the position on the rack in which those containers are to be located.

When the rack is complete and filled, the system is initialized with any existing racks in the system removed and the supply rack is positioned within the cabinet on the base at the location system 19. Similarly an empty discharge rack is located on the locating system 21.

At this stage the involvement of the operator is complete and the system is controlled and operated by the control unit to effect the operations as follows.

The robot arm firstly grasps the syringe from the rack and places the syringe on the support head 17 as previously described. The syringe is thus centered and located in position with the needle properly centered along the axis of the syringe. The robot arm then grasps an ultrasonic detection head of conventional type schematically indicated at 75 which is mounted in a storage location on the base 11. The ultra sonic scanning head is then lifted by the robot arm and moved back and forth across the positions on the rack for receiving the medication and diluent containers. The ultrasonic scanning head is responsive to the presence of a container and the diameter of that container and feeds this information to the control unit during the scanning action. When the scanning is complete, the control unit compares the scanned array of the containers with the previously generated and displayed array supplied to the operator to ensure that the operator has properly filled the required locations with the required dimensions of container. The dimensions of the container are available from the previously input information and these dimensions provide an initial indication of any fault in the supply of the container since an incorrect dimension of the container is indicative of the wrong container being supplied. In the event that a fault in the presence or dimension of a container is detected, the control unit provides an output of a fault condition requiring the operator to review the situation and to put right any errors in the supply of the containers.

In the event that the containers are properly in position as scanned, the robot arm returns the ultra sonic head to its storage position as shown and the robot head grasps a diluent container. As previously explained the grasping of the diluent container is effected at the neck of the container and the V shaped fingers of the robot arm act to center the diluent container at the required position so that the axis of the container lies along a predetermined position of the robot arm.

After picking up the diluent container, the robot arm firstly moves the diluent container to the bar code reader 36 and presents the bar code on the diluent container to the bar code reader for reading. This therefore acts as a second check on the accuracy of the materials in the supply rack since the control unit senses the bar code read and checks the bar code with the required bar code of the diluent required for the prescription and issues a fault signal in the event that the bar code is incorrect.

The robot arm then carries the diluent container to the needle, positions the diluent container so that the axis of the diluent container lies along the axis of the syringe and then moves the diluent container vertically downwardly onto the syringe. As previously described, the alignment of the needle by the jaws 50 and 51 and the centering of the vial by the fingers 72 and 73 ensures that the needle and the vial are properly aligned for penetration.

Prior to the diluent container being moved onto the syringe, the syringe is of course inverted by rotation of the head so that the needle is presented upwardly. In addition the plunger is extracted by the control unit to draw in a predetermined volume of air. The volume of air drawn in will vary depending upon the amount of volume of the syringe to be filled, which information is of course known by the control unit in dependence upon the prescription.

With the diluent container on the needle, the plunger is operated to extract a predetermined volume of liquid from the diluent container. This volume is selected so that that volume of liquid can be extracted from the container without reducing the pressure within the container to a vacuum sufficient to prevent movement of the plunger. After the predetermined volume of liquid is extracted, the plunger is expelled thus pumping air into the container to replace the liquid withdrawn. The plunger is then retracted to withdraw liquid from the diluent container to an amount equal to the air pumped into the container. The pumping of air and the withdrawing of liquid is then repeated by the drive system under the control of the control unit until the required amount of liquid is withdrawn. The control unit of course adds the amounts of liquid withdrawn until the predetermined amount of liquid is fully withdrawn and contained within the syringe.

The control unit actuates the syringe so that, after the first amount of liquid is withdrawn, it repeats the process of pumping in air and withdrawing liquid in equal amounts so that when the final amount of liquid is withdrawn there is a vacuum within the container. This vacuum is generated by the absence of the amount of liquid initially withdrawn.

When the withdrawing of liquid is thus complete, the robot arm acts to move the diluent container along its axis away from the needle to release the needle from the elastic membrane on the container. During this movement the syringe plunger is held stationary by the slot 57 of the head 56 to prevent liquid being drawn out from the needle by the vacuum. As there is a vacuum within the container, any drop of liquid remaining on the needle as it is withdrawn is pulled by that vacuum back in through the hole in the membrane to prevent what is known as "aerosol" in which the liquid escapes into the atmosphere. In practice, therefore, the needle when withdrawn is effectively dry so that there is little or no liquid escaping into the atmosphere as it is withdrawn. This is of course of particular importance in relation to noxious chemicals in which even a small amount escaping can lead to long term problems for operators.

The emptied or partially emptied diluent container is then carried by the robot arm to the discharge rack and placed in position thereon.

The medication container is then grasped by the robot arm, checked by the bar code reader and carried to the syringe. The syringe at this time is turned so that the needle faces downwardly. The robot arm moves the medication container to a position aligned on the axis of the syringe and then moves it vertically upwardly to engage on the needle. The plunger is then actuated to dispense into the medication container the required volume of the diluent. Again it is necessary to operate the plunger to dispense a measured proportion of liquid and then to extract a measured volume of air in a pumping action. The amounts of liquid supplied during this reciprocating pumping action are added by the control unit to determine the required volume and to halt dispensing when the required volume is dispensed. Again the injection of liquid and the extraction of air are arranged so that there is left a vacuum in the medication container when the dispensing of liquid is complete. This prevents "aerosol" as previously described. When the diluent is injected into the medication container, the medication container is oscillated to effect mixing of the diluent and the medication. This oscillation can be effected by placing of the container in the mixer 23 as previously described alternatively in cases where only limited amount of mixing is required, the mixing can be effected by oscillation of the container by the robot arm.

When the mixing is complete, the container is collected from the mixer and carried by the robot arm for extraction of a predetermined quantity of the mixed medication from the medication container into the syringe. The syringe at this time is empty as the diluent previously contained in this syringe has been injected into the medication container.

As previously explained, the medication container is moved to the top of the syringe support head which is again rotated to present the needle upwardly and the process for extraction of the liquid from the medication container is repeated as previously explained.

When the extraction from the medication container is complete, the medication container is carried by the robot arm to the storage rack 22 and the robot arm carries the IV bag from a storage position 20B on the rack 20 to the syringe support head. Again the syringe is rotated to be presented downwardly and the IV bag is moved into place. The IV bag is filled from the syringe simply by depressing the plunger since the IV bag can be expanded and there is no need to equalize pressures. When filled the IV bag is moved by the robot arm downwardly from the needle and onto the position 22B on the storage rack 22. The syringe is then grasped by the robot arm and also moved to the storage position 22A.

After the above steps are complete, the supply rack 20 is emptied and the discharge rack 22 is filled with the empty containers, the used syringe and the filled IV bag. The racks can then be removed from the base simply by lifting the rack away from the rack support 19, 21 which acts to locate the rack in fixed position on the base during the operation of the robot arm.

At each stage of the process, the syringe is weighed on the scale as previously described. In particular the syringe is weighed initially when empty, after completing filling with the predetermined quantity of diluent, after dispensing the diluent, after filling with the predetermined quantity of the medication and after dispensing the medication into the IV bag. The IV bag is also weighed before and after filling by hanging on the bracket as previously described. This information ensures that the correct quantities of the materials are transmitted between the various elements and that the IV bag is indeed properly filled with the required quantity of the medication.

Figure 7:
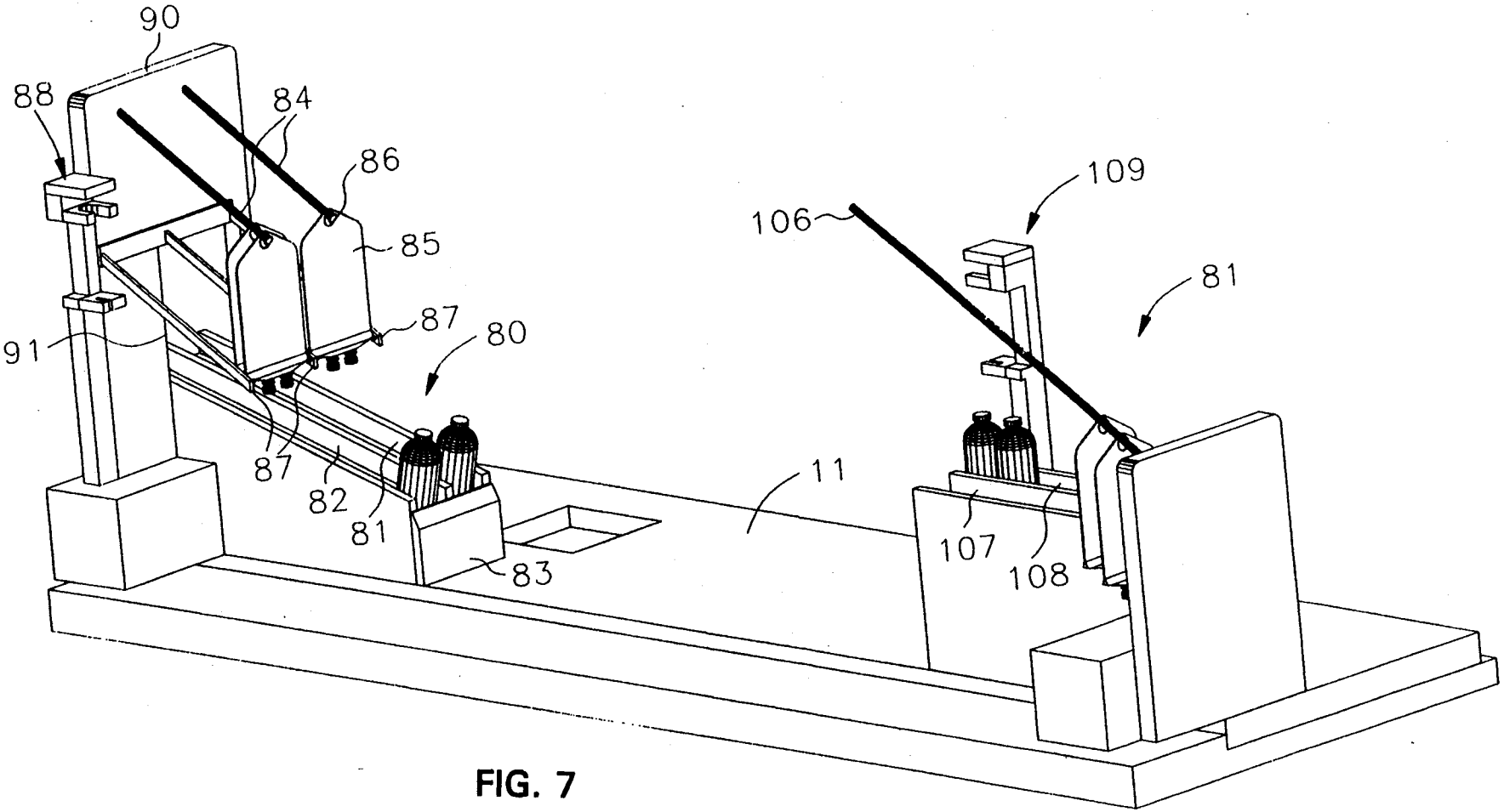
FIG. 7 is an isometric view of the system of FIG. 1 showing only the batch type supply and discharge rack.
Figure 8:
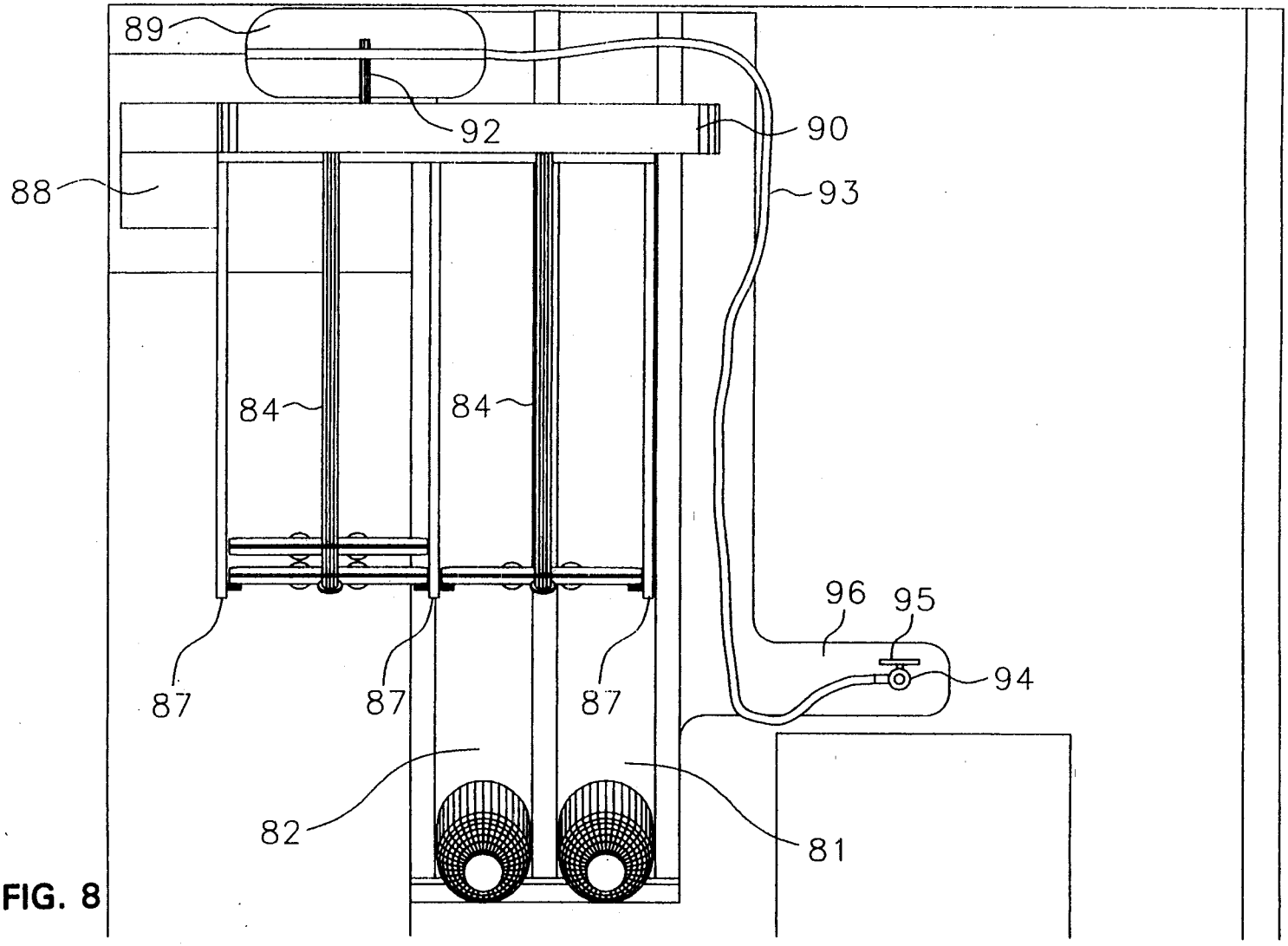
FIG. 8 is a top plan view of the supply rack of FIG. 7.
Figure 9:
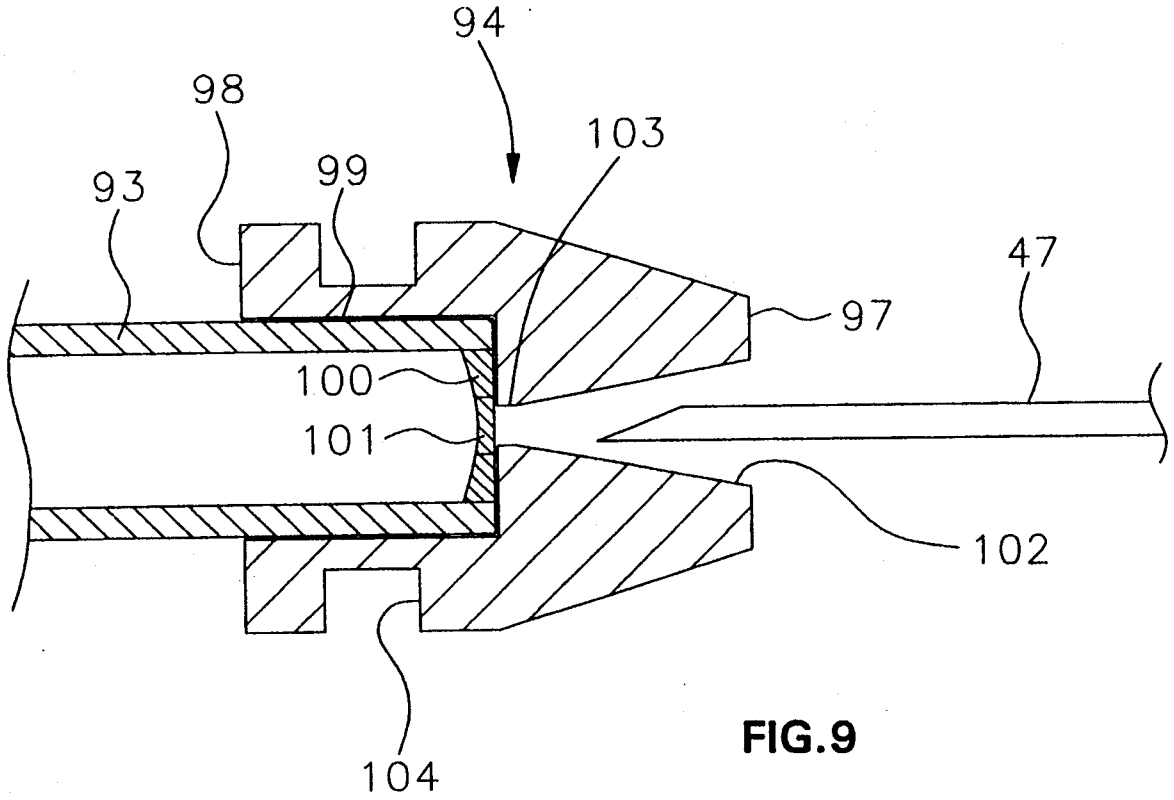
FIG. 9 is a cross-sectional view of the diluent dispensing nozzle of FIG. 8.

Turning now to FIGS. 7, 8 and 9 there is shown a modified supply rack and a modified discharge rack for use with batch processing of IV bags. In FIG. 7 the base 11 is again shown but the only elements shown mounted on the base are the supply rack indicated at 80 and the discharge rack indicated at 81 and these mount on the same support block 19 and 21 which are used for the supply and discharge racks shown in FIG. 1. It will be appreciated, therefore, that when it is intended to manufacture a batch of the IV bags, the single supply and discharge racks are removed and the multiple supply and discharge racks 80 and 81 are installed in their place carrying the necessary elements.

The supply rack 80 comprises a pair of inclined channels 81 and 82 for receiving medication containers. The channels line the containers up in a pair of parallel rows so that the containers slide downwardly along the channels to a front wall 83 of the supply rack. As previously described, therefore, the robot arm can lift the required containers from the channels 81 and 82 for operation in the filling process. Furthermore the supply rack comprises a pair of inclined rods 84 which support IV bags 85 by a loop 86 at a top end of the IV bag. The bottom end of the IV bag is guided between rails 87 so that two rows of the IV bags are presented to the robot arm. The inclined nature of the rods again causes the bags to slide downwardly to a front end stop on the rod 84.

The rack further includes a location 88 for an empty disposable syringe of the type previously described. The medication containers are as previously described supplied in the channels 81 and 82 which are of sufficient size to receive a relatively large number of the medication containers perhaps up to 30 for filling 30 IV bags. The diluent for the medication is supplied in an IV bag 89 mounted on a rear face of a rear wall 90 of the supply rack. The rear wall 90 is upstanding from a rear end of the channels 80 and 81. The rear wall has an opening 91 through which the channels 81 and 82 pass so that the medication containers can be loaded from the rear of the rear wall 90 and slide downwardly along the channel to the front wall 83. The rods 84 and the guide bars 87 are suspended in cantilever arrangement from the front surface of the rear wall 90. The diluent IV bag 89 is carried on a pin 92 projecting rearwardly from the rear wall 90. A dispensing tube 93 extends from the bottom of the IV 89 bag to a guide head 94 at the end of the tube 93. The guide head is supported on a bracket 95 carried on an arm 96 projecting outwardly to one side of the device adjacent the front of the channels 81 and 82. The guide head 94 is thus presented to the robot arm for grasping by the robot arm in place of the diluent container in the technique previously described.

The shape of the guide head 94 is shown in more detail in FIG. 9 and comprises a front end 97 and a rear end 98, the latter having a central opening 99 into which the end of the supply tube 93 is inserted. The supply tube 93 is of a type including an end closure 100 having a relatively small central elastic membrane 101 which is shaped to receive the needle 47. At the front end 97 of the guide head is provided a conical opening 102 which tapers to a cylindrical channel 103 within the body of a guide head. The conical opening thus guides the needle 47 to ensure that it is directed into the relatively narrow channel 103 for engaging the membrane 101 for penetration into the end of the tube 93. The body of the guide head includes an annular recess 104 forming a neck which can be grasped by the fingers of the robot arm as previously described.

The discharge rack 81 is similar to the supply rack in that it includes a discharge guide rod 106 for receiving the filled IV bags in sliding action along the inclined rod 106. The discharge rack further includes a pair of channels 107, 108 similar to the channels 81 and 82 but these are not inclined since the medication containers can be pushed by the robot arm along the channels 107, 108, each pushing the next containers in line. The discharge rack further includes a support 109 for the used syringe.

The operation of the system using the batch processing racks is effectively the same as previously described. The robot arm acts to carry the guide head 94 to the syringe for extraction of diluent, replaces the guide head, grasps a medication container, fills the medication container with a diluent, moves the medication container to the mixer, returns the medication container when mixed to the syringe, extracts the quantity of medication and fills that quantity into the selected IV bag. The control unit is arranged to manage the system so that the most efficient filling of the IV bag is effected using the dimensions of the medication containers available. Thus the system can minimize wastage of the diluent and medication, minimize the number of medication containers used and effect the filling of the IV bags in a minimum number of steps.

The mixer as previously described includes two mixer heads so that two medication containers can be in place simultaneously receiving mixing action. While the two containers are being mixed, the robot arm can of course be operating the other steps in the process using a further medication container. Depending upon requirements, more than two mixing heads may be provided. The stationary location on the mixing head allows a container to be placed on one side while a mixed container is removed from a mixing head. The system may therefore include no stationary locations at the mixing head or may include a number of such stations as required depending upon the amount of time required for mixing of the medication relative to the amount of time necessary for the other steps in the process.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An apparatus for filling a dispensing container with a medication for a patient comprising:

a support head having means thereon for holding a disposable syringe, the syringe having a needle, a syringe cylinder and a plunger movable longitudinally therein for drawing into and expelling from the needle liquids and drive means for driving longitudinal movement of the plunger;

supply means for supplying at least one medication container and at least one diluent container means for manipulating the medication container and the diluent container relative to the needle for engaging the needle into the medication container for communication of liquid between the syringe and the medication container and separately into the diluent container for communication of liquid between the syringe and the diluent container;

and a control unit arranged for extracting a measured quantity of diluent from the diluent container into the syringe, for expelling the diluent from the syringe into the medication container for mixing with medication in the medication container, and for extracting a measured quantity of the mixed medication from the medication container into the syringe;

the support head including engagement means for engaging the syringe cylinder and for holding the cylinder against longitudinal movement and against movement transverse to the longitudinal movement and needle grasping means mounted on the support head for grasping the needle at a position on the needle spaced from the cylinder so as to hold the needle on a longitudinal axis of the cylinder, the needle grasping means being separate from the medication container and from the diluent container so that the needle is held on said longitudinal axis prior to engagement of said needle into said medication container and prior to engagement of said needle into said diluent container.

2. The apparatus according to claim 1 wherein the needle grasping means comprises a pair of grasping elements movable in a plane at right angles to the needle, each of the grasping elements defining cam surfaces for engaging the needle and moving the needle toward the axis.

3. The apparatus according to claim 1 wherein the manipulating means includes container grasping means for grasping a respective one of the medication container and the diluent container and means for relatively moving the respective container and the needle, the container grasping means including means for centering the respective container at a predetermined position on the container grasping means for movement of that predetermined position to the axis of the cylinder.

4. The apparatus according to claim 3 wherein the manipulating means comprises a robot arm and wherein the container grasping means comprises fingers on the robot arm for engaging the respective container on respective sides thereof, the fingers being movable in a plane at right angles to the longitudinal axis and wherein the fingers include cam surfaces thereon tending to move the respective container longitudinally of the fingers to said predetermined position.

5. The apparatus according to claim 1 including a robot arm for engaging and moving the syringe from the supply means to the support head, the robot arm having engagement fingers for grasping the syringe cylinder, the support head having slot means therein for receiving a flange at an end of the syringe cylinder and means at the slot means for engaging the flange to hold the cylinder against longitudinal movement.

6. An apparatus for filling a dispensing container with a medication for a patient comprising:

a support head having means thereon for holding a disposable syringe, the syringe having a needle, a syringe cylinder and a plunger movable longitudinally therein for drawing into and expelling from the needle liquids and drive means for driving longitudinal movement of the plunger;

supply means for supplying at least one medication container and at least one diluent container means for manipulating the medication container and the diluent container relative to the needle for engaging the needle into the medication container for communication of liquid between the syringe and the medication container and separately into the diluent container for communication of liquid between the syringe and the diluent container;

and a control unit arranged for extracting a measured quantity of diluent from the diluent container into the syringe, for expelling the diluent from the syringe into the medication container for mixing with medication in the medication container, and for extracting a measured quantity of the mixed medication from the medication container into the syringe;

and weighing means for weighing the syringe before and after transfer of liquid to and from the syringe, the weighing means being mounted on the support head such that the weight of the syringe can be detected while the syringe is supported on the support head.

7. The apparatus according to claim 6 wherein the support head is mounted on a horizontal support shaft for rotation about a horizontal axis from a first position presenting the needle upwardly to a second position presenting the needle downwardly and wherein the weighing means comprises a balance scale connected to the support shaft of the support head.

8. The apparatus according to claim 6 including a dispensing container separate from the syringe for receiving liquid from the syringe and including means for suspending the dispensing container from the support head for detecting the weight of the dispensing container.

9. The apparatus according to claim 6 wherein the control unit is arranged to receive information concerning the weight of the syringe before and after transfer of liquid to and from the syringe and means for storing said information to provide an audit trail relating to said transfer of liquid.

10. An apparatus for filling a dispensing container with a medication for a patient comprising:

a support head having means thereon for holding a disposable syringe, the syringe having a needle, a syringe cylinder and a plunger movable longitudinally therein for drawing into and expelling from the needle liquids and drive means for driving longitudinal movement of the plunger;

supply means for supplying at least one medication container, which is a closed container having a penetrable membrane and, at least one diluent container;

means for manipulating the medication container and the diluent container relative to the needle for engaging the needle into the medication container through the penetrable membrane thereof for communication of liquid between the syringes and the medication container and separately into the diluent container for communication of liquid between the syringe and the diluent container;

and a control unit arranged for extracting a measured quantity of diluent from the diluent container into the syringe, for expelling the diluent from the syringe into the medication container for mixing with medication in the medication container, and for extracting a measured quantity of the mixed medication from the medication container into the syringe;

said control unit being arranged to operate said drive means so as to move the plunger to extract liquid through the penetrable membrane thereof from the medication container and so as to inject air into the medication container to replace the liquid withdrawn therefrom, said control unit being arranged such that the volume of air injected into the medication container is less than the volume of liquid withdrawn therefrom so as to leave a partial vacuum within the medication container, said control unit being further arranged to operate said manipulating means and said support head so as to remove the penetrable membrane of the medication container from the needle while holding the drive means in fixed position so that the needle is withdrawn from the medication container while the partial vacuum is maintained in the medication container to inhibit the escape into the atmosphere of liquid from the needle and the medication container as the needle is withdrawn.

11. The apparatus according to claim 10 wherein the support head is arranged to provide a position thereof presenting the needle upwardly and wherein the control unit is arranged to operate the drive means to firstly draw into the syringe a volume of air, and subsequently to reciprocate the drive means with the medication container in engagement with the needle to repeatedly inject air into the medication container and to withdraw liquid from the medication container.

12. An apparatus for filling a dispensing container with a medication for a patient comprising:

a support head having means thereon for holding a disposable syringe, the syringe having a needle, a syringe cylinder and a plunger movable longitudinally therein for drawing into and expelling from the needle liquids and drive means for driving longitudinal movement of the plunger;

supply means for supplying at least one medication container and at least one diluent container means for manipulating the medication container and the diluent container relative to the needle for engaging the needle into the medication container for communication of liquid between the syringe and the medication container and separately into the diluent container for communication of liquid between the syringe and the diluent container;

a control unit arranged for extracting a measured quantity of diluent from the diluent container into the syringe, for expelling the diluent from the syringe into the medication container for mixing with medication in the medication container, and for extracting a measured quantity of the mixed medication from the medication container into the syringe;

the supply means comprising a plurality of separate supply racks each having a supply rack body movable relative to the base as an integral member and defining on the supply rack body support positions for a single syringe only, a plurality of medication containers, and at least one diluent container;

a base member for receiving the support head and the manipulating means;

and locating means on the base member for readily releasably receiving each supply rack body in turn and for locating the supply rack body at a specific required location on the base member such that each supply rack body can be removed and replaced with a subsequent supply rack body at the same specific required location for a subsequent dispensing container.

13. The apparatus according to claim 12 including a plurality of discharge racks each having means thereon for receiving the diluent container, the medication containers and the syringe and wherein the base has engagement means thereon for receiving and locating each discharge rack in turn such that the containers and the syringe are moved from the supply rack to the discharge rack by the manipulating means.

14. The apparatus according to claim 12 wherein the control unit includes means for calculating required medication and diluent containers to be mounted on a required one of the supply racks for the mixed medication and includes a display means for displaying to an operator required locations on said one of the supply racks for the required medication and diluent containers.

15. The apparatus according to claim 12 including scanning means for scanning said one of the supply racks to detect the presence and dimensions of the required medication and diluent containers thereon and means for generating a fault signal in response to detection of an error in the location or dimensions of the required medication and diluent containers on said one of the supply racks.

16. The apparatus according to claim 12 wherein the base member is dimensioned to be received within a conventional biological containment cabinet such that the base member, support head, manipulating means and supply rack can all be located within the biological containment cabinet and such that a supply rack on the base member can be removed from the biological containment cabinet and replaced by a further one of said plurality of supply racks.

17. An apparatus for filling a dispensing container with a medication for a patient comprising:

a support head having means thereon for holding a disposable syringe, the syringe having a needle, a syringe cylinder and a plunger movable longitudinally therein for drawing into and expelling from the needle liquids and drive means for driving longitudinal movement of the plunger;

supply means for supplying at least one medication container and at least one diluent container means for manipulating the medication container and the diluent container relative to the needle for engaging the needle into the medication container for communication of liquid between the syringe and the medication container and separately into the diluent container for communication of liquid between the syringe and the diluent container;

a control unit arranged for extracting a measured quantity of diluent from the diluent container into the syringe, for expelling the diluent from the syringe into the medication container for mixing with medication in the medication container, and for extracting a measured quantity of the mixed medication from the medication container into the syringe;

the manipulating means comprising a robot arm for grasping and moving the diluent and medication containers and wherein there is provided an oscillating mixer means separate from the robot arm and from the support head arranged to receive a medication container from the robot arm and for oscillating the medication container for mixing the medication and diluent, the robot arm being arranged such that it can insert the medication container into the mixer means and remove the medication container from the mixer means after mixing and such that the robot arm can co-act with the support head for transferring liquid to and from the syringe while the mixer means oscillates said medication container.

18. The apparatus according to claim 17 wherein the mixer means includes a mixer head including a pivotal cradle, means for pivoting the cradle in a mixing action, a fixed abutment on the cradle for engaging a container to be mixed, a movable abutment, and means biasing the movable abutment toward the fixed abutment to pinch the container therebetween, the movable abutment having a portion thereon for engagement by the container when carried by the robot arm for moving the movable abutment away from the fixed abutment to allow insertion of the container therebetween, at least one of the abutments having a V-shape surface for locating the container.

* * * * *